United States Patent [19]

Kastening et al.

[11] 4,053,402

[45] Oct. 11, 1977

[54] PROCESS FOR PRODUCING SULFONES

[75] Inventors: Bertel Kastening; Dierk Knittel, both of Hamburg, Germany

[73] Assignee: Kernforschungsanlage Julich GmbH, Julich, Germany

[21] Appl. No.: 647,812

[22] Filed: Jan. 9, 1976

Related U.S. Application Data

[63] Continuation-in-part of Ser. No. 474,167, May 29, 1974, Pat. No. 3,980,535.

[30] Foreign Application Priority Data

Jan. 10, 1975 Germany ..... 2500727

[51] Int. Cl.[2] ..... C25B 3/04

[52] U.S. Cl. ..... 204/59 R

[58] Field of Search ..... 204/59 R, 72; 260/607 AL

[56] References Cited

U.S. PATENT DOCUMENTS

| | | | |
|---|---|---|---|
| 3,344,047 | 9/1967 | Neikam | 204/59 R |
| 3,764,492 | 10/1973 | Boizer et al. | 204/59 R |

OTHER PUBLICATIONS

Knittel et al, J. of Applied Electrochemistry, pp. 291–296, (1973).

*Primary Examiner*—F.C. Edmundson
*Attorney, Agent, or Firm*—Karl F. Ross

[57] ABSTRACT

A process for producing sulfones in which sulfur dioxide is electrolytically transformed into $SO_2^-$ ions and caused to react with organic compounds having functional groups replaceable by $SO_2^-$, in an aprotic organic solvent, to produce the corresponding organosulfone. According to the present improvement, an ester such as sulfonic acid or sulfuric acid ester, is added to the solvent as an organic compound capable of reacting with halogen ions of a salt, such as tetraalkylamoniumhalogenide or tetraalkylphosphoniumhalogenide, introduced into the solvent as a conductivity-promoting agent.

6 Claims, 1 Drawing Figure

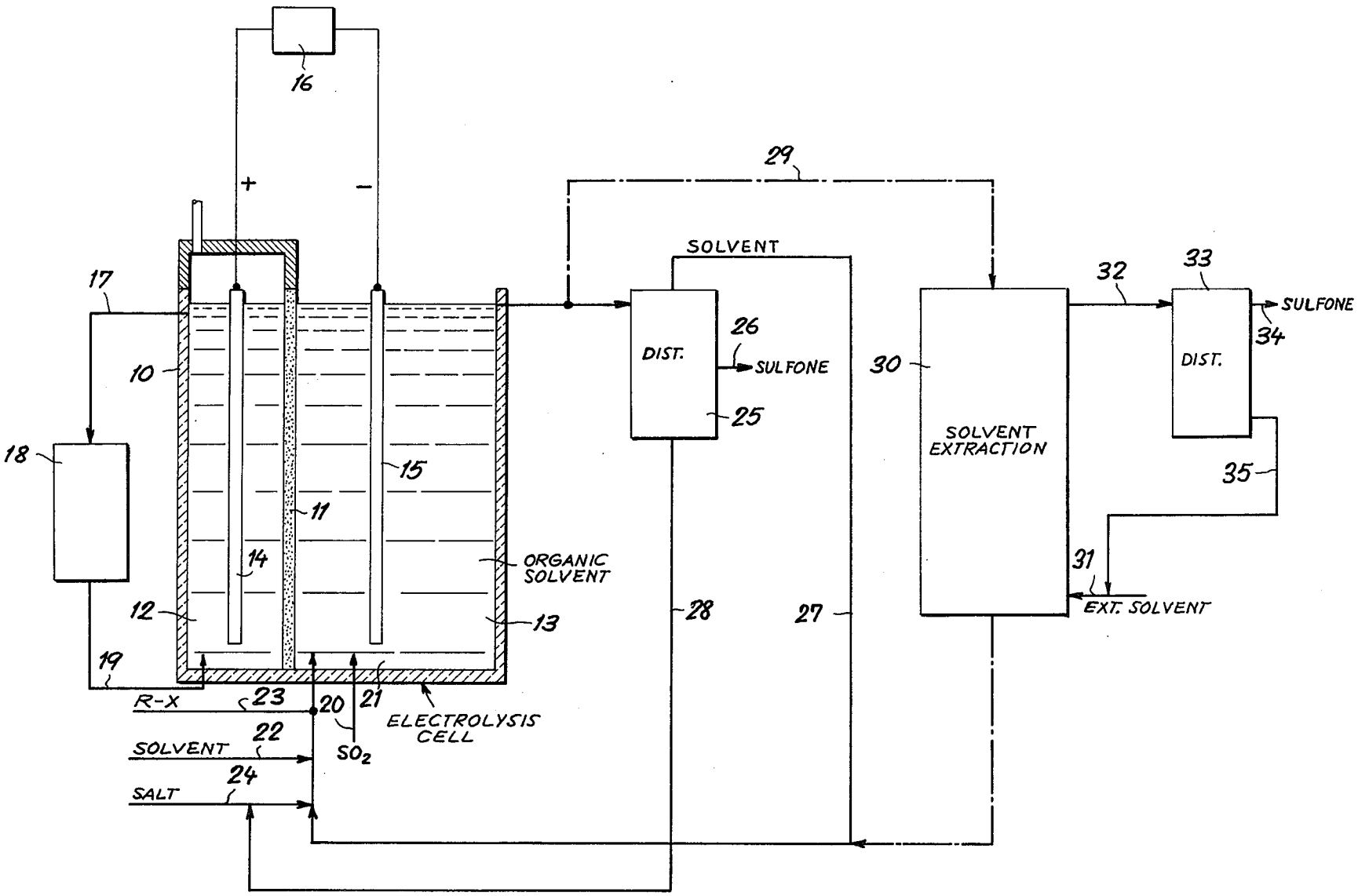
SULFONE
34
33
DIST.
35
32
EXT. SOLVENT
31
SOLVENT EXTRACTION
30
29
27
SOLVENT
26
SULFONE
25
DIST.
28
ORGANIC SOLVENT
13
ELECTROLYSIS CELL
15
21
$SO_2$
20
16
11
14
23
22
24
10
12
R-X
SOLVENT
SALT
17
19
18

PROCESS FOR PRODUCING SULFONES

CROSS REFERENCE TO RELATED APPLICATION

This application is a continuation-in-part of our application Ser. No. 474,167 filed May 29, 1974 and entitled PROCESS FOR PRODUCING SULFONES, now U.S. Pat. No. 3,980,535 issued Sept. 14, 1976.

FIELD OF THE INVENTION

The present invention relates to a process for the production of organosulfones or mixtures of sulfones and, more particularly, to improvements in the process described in our earlier application identified above.

BACKGROUND OF THE INVENTION

Organosulfones are useful in a number of fields, e.g. the manufacture of plastics (synthetic resins) and fabric finishing, as additives to textile fibers, as dyestuffs or dyeing aids, and as therapeutic compounds in a variety of processes and treatments. Sulfones are particularly convenient surface-active agents in the chemical process arts.

Prior to the system described in the abovementioned copending application, sulfones were made principally by several different techniques whereby an organic compound R—X was reacted with sodium sulfide ($Na_2S$) to yield the organic sulfide R—S—R in accordance with the formula:

$$2\,R{-}X + Na_2S \rightarrow R{-}S{-}R + 2NaX$$

In this relationship, X is generally a halogen atom, S is sulfur and R is the organic radical.

The organosulfide R—S—R is oxidized in a second stage to the sulfone with an oxidizing medium or by catalytic oxidization in a reaction which can be represented by the formula:

$$R{-}S{-}R + O_2 \rightarrow R{-}SO_2{-}R,$$

where the reaction product is the sulfone.

These processes and others known in the art not only required a plurality of steps, but frequently isolation of intermediates, such as the organosulfide before subsequent steps were undertaken. Such processes are neither economical nor convenient and were time consuming and frequently had poor yields.

These disadvantages were overcome in the system described in the aforementioned copending application which, in turn, is developed further in our publication Elektrosynthese Symmetrischer Und Unsymmetrischer Sulfone, *Berichte der Bunsen-Gesellschaft fur Physikalische Chemie (earlier Zeitschrift fur Elektrochemie),* Volume 3, Nov. 30, 1973, and our publication entitled Electrosynthesis of Sulfones, *Journal of Applied Electrochemistry,* Vol. 3 (1973) pages 291to 295.

In our system as described in the aforementioned application, sulfones are produced in a single-stage reaction by electrolyzing sulfur dioxide in an aprotic organic solvent in which the organic compound R—X is soluble and which is provided with a salt for promoting conductivity of the solvent. The electrolysis produces $SO_2^-$ ions which can replace the X groups of the organic compound.

As described in the aforementioned application, the process for the production of sulfones utilizes the fact that the $SO_2^-$ ion can replace certain functional groups of an organic compound in an organic medium (nonaqueous solvent) in which the $SO_2^-$ ion is produced by electrolysis. While the atoms or groups of a number or organic compounds have been found to be replaceable by $SO_2^-$ ions formed by electrolysis of $SO_2$ in the organic medium, the compounds which are found to be most reactive for this purpose are the organic halogen compounds (i.e. compounds of the formula R—X in which X is chlorine, bromine or iodine), the sulfuric acid esters and the sulfonic acid esters. Thus X may also represent sulfuric acid ester group or the sulfonic acid ester group.

The overall reaction, therefore, can be represented by the formula:

$$2e^- + 2R{-}X + SO_2 \rightarrow R{-}SO_2{-}R + 2X^-$$

where the electrolysis reaction is represented by the addition of electrons to the reaction system, ultimately resulting in the formation of ions of the replaced functional groups. The product is, of course, the organosulfone $R{-}SO_2{-}R$.

As noted, the reaction is carried out in an aprotic organic solvent (nonaqueous medium) containing a salt, preferably a quaternary ammonium salt, designed to provide the necessary conductivity for the electrolysis current which transforms the $SO_2$ into $SO_2^-$. Preferably the salt is a tetraalkylammonium salt such as tetramethyl or tetraethylammoniumchloride or bromide.

According to the present invention the organic compound is introduced into the medium or constitutes the reaction vehicle in which the sulfur dioxide is dissolved and the system is then subjected to electrolysis. Of course, a system in which the organic compound is in liquid form and can constitute the reaction medium or vehicle as well as one of the reactants, has the advantage that recovery of the sulfone is simplified. Organic compounds which can operate in this manner are dimethylsulfate, chloroacetonitrile and chloroacetone. The latter compounds require no separate solvent.

It has been found to be advantageous to prevent the electrolysis current from exceeding the maximum usable current density that produces only the $SO_2^-$ ions. This can be accomplished by providing in the electrolysis cell a reference electrode which is not traversed by the electrolysis current and controlling the voltage between the reference electrode and the cathode so that with respect to the standard potential of the sulfur dioxide/sulfur dioxide anion REDOX couple ($SO_2/SO_2^-$), the potential does not exceed 0.1 volt. It has been found that best results are obtained when the sulfur dioxide concentration in the solution during electrolysis is at least 0.1 mole/liter.

The process of the present invention also has the significant advantage that it is possible to produce polymeric sulfones readily. It is only necessary, to this end, to use an organic compound of the type X—R—X where R is a difunctional organic radical and X is an atom or group replaceable by $SO_2^-$. The reaction follows the overall formula:

$$2n(X{-}R{-}X) + 2n(SO_2) + 4ne^- \rightarrow \left(R{-}SO_2{-}R{-}SO_2\right)_n + 4nX^-$$

where $n$ is an integer, $e^-$ is the electronic charge, R and X have their earlier-stated meanings, and $\left(R{-}SO_2{-}R{-}SO_2\right)$ is the repeating group of the polymer.

Of course cyclic sulfones can also be produced from organic compounds having terminal X groups, the C atoms to which they are attached being bridged by the $—SO_2—$ group.

It has been found to be most advantageous to carry out the reaction in an electrolysis cell subdivided by a diaphragm or ion-exchange membrane into a cathode compartment and an anode compartment. When an anion ion-exchange membrane is used, the current through the cell is brought about solely by migration of the anions $X^-$ liberated by the cathodic process. The anions traverse the membrane and are oxidized by the anode. When X is a halogen atom, preferably chlorine or bromine, the halogen $X_2$ is liberated at the anode as the free halogen. The sulfone is formed in the cathode compartment. The system has been found to reduce side reactions which might tend to form impurities. A cell of the character described has been found to have an especially high yield of sulfones.

In the process of the present invention, the sulfones or sulfone mixtures can be separated from the solvent by the distillation or by extraction with the extraction effluent then being distilled. For the extraction solvent, it is preferred to use a compound in which the salts (provided for conductivity) are insoluble. Such a solvent may be chloroform or petrolether. The salt recovered in this manner may be recycled to the cell and even the free halogen may be used in ancillary chemical reactions.

OBJECT OF THE INVENTION

It is the object of this invention to improve upon the process described in the aforementioned copending application.

SUMMARY OF THE INVENTION

We have now found that it is possible to improve the efficacy and economy of the process described in the aforementioned application by providing, in the aprotic solvent, an organic ester capable of reacting with the halogen ion of the conductivity-promoting salt resulting, by substitution of the acid group of the ester by halogen (chlorine, bromine, iodine) atom, in an organic halogen compound which participates in the sulfone-forming reaction.

Thus the essential feature of the present improvement is the provision of an organic compound in the aprotic organic solvent which is capable of forming an organic halogen compound with the halogen ion of the conductivity-promoting salt. Best results have been obtained with compounds of the sulfonic acid esters or esters of organic oxygen-containing acids may be used.

According to the invention, polymeric sulfones may be produced in accordance with the relationship:

$$2n(X—Z) + 2nSO_2 + 4ne^- \rightarrow +Z—SO_2—Z—SO_2+_n + 4nX^-$$

where Z is a difunctional organic radical, X is a halogen (e.g. chlorine, bromine or iodine), $e^-$ is the electronic charge, $X^-$ is the halogen ion and $n$ is an integer representing the number of repeating units in the polymer.

The process is, as described in the parent application, also capable of producing cyclic sulfones. It is desirable in this case to use multi-substituted organic compounds whose substituents can be replaced by halogen ions in the formation of the corresponding organic halogenides. A typical compound of this type is 1,4-di-p-toluenesulfonyloxybutane.

The process is carried out in an electrolysis cell which is subdivided by a diaphragm or an anion-exchange membrane into a cathode compartment and an anode compartment. The current flow is primarily by migration of the anion X' set free by the cathodic process and transported to the anode compartment. The anions are oxidized at the anode. The sulfone is recovered from the cathode compartment. The use of such an electrolysis cell has been found to give an especially high yield of sulfones and the $SO_2^-$ ions are found to react with the organic compound directly and practically simultaneously with their formation upon electrolysis. The sulfones are separated from their solution in the solvent by distillation or extraction. Preferably the extraction is carried out with a solvent in which the conductivity-promoting salt is insoluble, such as chloroform or petrolether.

BRIEF DESCRIPTION OF THE DRAWING

The above and other objects, features and advantages of the present invention will become more readily apparent from the following description, reference being made to the accompanying drawing in which the sole FIGURE is a flow diagram illustrating the invention.

SPECIFIC DESCRIPTION

In the drawing, there is shown an electrolysis cell 10 which is subdivided by an anion exchange membrane 11 into an anode compartment 12 and a cathode compartment 13 respectively containing the anode 14 and the cathode 15. A source of constant direct current 16 is connected across the electrodes 14, 15. The electrolyte contained in the anode compartment 12 is led at 17 to a halogen remover 18 where the halogen generated at the anode 14 is removed by extraction or distillation from the electrolyte, the latter being recycled at 19 to the anode compartment 12. Sulfur dioxide gas is introduced at 20 into the organic medium 21 within the cell, the medium consisting of a solvent introduced at 22; the organic compound is introduced at 23 and the conductivity-promoting salt is introduced at 24.

The reaction products are led into a distilling column 25 from which the sulfone is recovered (i.e. obtained or withdrawn) at 26, solvent is recovered at 27 and recycled to the cell, and the salt is recovered at 28 and likewise recycled.

Alternatively, the reaction products may be led at 29 to a solvent-extraction column 30 into which the extraction solvent is introduced at 31. The extract is withdrawn at 32 and subjected to distillation at a column 33 to recover (i.e. obtain or withdraw) the sulfone at 34 and solvent at 35, the latter being recycled to the extraction stage.

SPECIFIC EXAMPLES

Example I

Dibutyl sulfone is produced in an electrolysis cell as described and subdivided by an anion ion exchange member into a cathode compartment and an anode compartment. The anode is a glassy carbon electrode and the cathode is platinum with an effective surface area of 13 $cm^2$. The solvent is acetonitrile and tetraethylammoniumbromide is introduced into the solvent system in a concentration of 0.2 moles per liter. Similar tests were carried out with tetraalkylphosphoniumhalogenide, tetraarylammoniumhalogenide and tetraarylphosphoniumhalogenide, the halogens being chlorine, bromine and iodine, the alkyl groups being $C_1$–$C_6$ straight and branch chain radicals and the aryl groups being phenyl and alkyl-substituted phenyl with the alkyl group having 1–6 carbon atoms. The solvent was contained in the cathode compartment as well as in the anode compartment. Sulfur dioxide is dissolved in the solvent in the cathode compartment to a concentration of 5 molar.

The organic compound which is capable of reacting with the halogen ions released by the tetraethylammoniumbromide to form organic halogenides was n-butyl-p-toluene-sulfonate. During the electrolysis sulfur dioxide was added to the cathode compartment to replace consumed $SO_2$. Electrolysis was carried out at a constant current density of 38.5 mA/cm$^2$ at a temperature of 80° C. After a current flow corresponding to 3800 coulombs, electrolysis was terminated.

The solvent from the cathode compartment was distilled off by distillation and the residue was dissolved in water and chloroform. Fractional distillation of the chloroform phase yielded in succession, chloroform, unreacted n-butyl-p-toluenesulfonate, byproducts and dibutylsulfone. The dibutylsulfone was recovered with a purity of 95% and a yield, based upon the current flow of about 63%.

Example II

In a manner analogous to that described in Example I, dibenzyl sulfone is produced. Tetrabutylphosphoniumchloride is added to the solvent. The compound reacting with halogen ion is benzyl-p-toluenesulfonate. Electrolysis was carried out at a constant current density of 38.5 mA/cm$^2$ at a temperature of 80° C. After a current flow 3800 coulombs the reaction was terminated. Subsequently the solvent was driven off from the reaction mixture in the cathode compartment by distillation and the residue was dissolved in water and chloroform. The dibenzylsulfone was recovered by crystallization after evaporation of the chloroform with a purity of 85%. The yield, based upon the current flow, was between 60 and 70%.

The critical parameters of the present process in terms of current density and cell voltage are determined by providing in the electrolysis cell a reference electrode which is not traversed by the electrolysis current and controlling the voltage between the reference electrode and the cathode so that, with respect to the standard potential of the $SO_2/SO_2^-$ Redox couple, the potential does not exceed 0.1 volt. As in the system of the prior application, best results are obtained when the sulfur dioxide concentration in solution is at least 0.2 mole/liter. The maximum effective sulfur dioxide concentration is the solubility limit of $SO_2$ in the solution.

The temperature at which the reaction is carried out can be between the freezing point and boiling point of the solution although best results are obtained between room temperature (about 20° C) and the boiling point of the solution. Elevated temperatures, i.e. temperatures above room temperature, improve the results over lower temperatures although there is no specific range which can be defined as giving optimum results. For example, excellent results are obtained between 30° C and the boiling point of the solution.

In general a temperature of about 60° to 90° C, preferably about 80° C has proved to be the best mode.

The solvent can be any aprotic organic solvent in which the salt, the organic ester and the sulfur dioxide are soluble and which will not engage in electrolytic actions adverse to the desired reaction. Best results are obtained with acetonitrile, dimethylformamide and dimethyl sulfoxide.

As far as the concentration of the salt and other reactants are concerned, it should be noted that the preferred concentration of the ester is at least 0.1 molar up to the saturation limit of this compound in the solvent. The salt should be present in at least equimolar concentration with the ester and thus should also be present in a minimum concentration of 0.1 normality up to a normality or molarity corresponding to the saturation limit of the ester.

We claim:

1. A process for producing a sulfone which comprises the steps of:

a. introducing into the cathode compartment of an electrolysis cell subdivided into an anode compartment and a cathode compartment a reaction system comprising an aprotic organic solvent, a conductivity-promoting salt soluble in said solvent and, which salt releases halogen ions, said salt being selected from the group which consists of tetraalkylammoniumhalogenide, tetraalkylphosphoniumhalogenide, tetraarylammoniumhalogenide and tetraarylphophoniumhalogenide wherein the halogen is chlorine, bromine or iodine, sulfur dioxide, and an organic ester selected from the group consisting of a sulfonic acid ester, a sulfuric acid ester or an ester of another oxygen-containing acid capable of reacting with the halogen ions released by said salt; and b. electrolyzing said reaction system at a current density, temperature and voltage sufficient to transform said sulfur dioxide into $SO_2^-$ ions and react said ester to produce the corresponding organosulfone in said cathode compartment, said organosulfone being separable from the solvent.

2. The process defined in claim 1 wherein said compound is a sulfonic acid ester.

3. The process defined in claim 2 wherein said compound is selected from the group which consists of n-butyl-p-toluenesulfonate and benzyl-p-toluenesulfonate.

4. The process defined in claim 1 wherein said salt is selected from the group which consists of tetraethylammoniumbromide and tetrabutylphosphoniumchloride.

5. The process defined in claim 1 wherein the organosulfone is recovered from the solvent by evaporating the solvent from the reaction system of said cathode compartment, treating the evaporation residue with water and chloroform, separating the chloroform phase from the water phase, and driving chloroform out of said chloroform phase to produce said organosulfone.

6. The process defined in claim 1 wherein the organosulfone is recovered from the solvent by extracting the organosulfone with a liquid and subjecting the extraction liquid to distillation.

* * * * *